US007410007B2

(12) United States Patent
Chung et al.

(10) Patent No.: US 7,410,007 B2
(45) Date of Patent: Aug. 12, 2008

(54) IMPACT ROTARY TOOL WITH DRILL MODE

(75) Inventors: Koon For Chung, Sai Kung (HK); Hoi Pang Wang, Tseung Kwan O (HK)

(73) Assignee: Eastway Fair Company Limited, Tortola (VG)

( * ) Notice: Subject to any disclaimer, the term of this patent is extended or adjusted under 35 U.S.C. 154(b) by 107 days.

(21) Appl. No.: 11/225,784

(22) Filed: Sep. 13, 2005

(65) Prior Publication Data

US 2007/0056756 A1 Mar. 15, 2007

(51) Int. Cl.
*E02D 7/06* (2006.01)

(52) U.S. Cl. ..... 173/48; 173/176; 173/216; 173/93; 173/93.6; 173/178

(58) Field of Classification Search ..... 173/47, 173/48, 176, 178, 216, 93, 93.6; 475/299, 475/169; 192/56.56, 56.6
See application file for complete search history.

(56) References Cited

U.S. PATENT DOCUMENTS

| | | | | |
|---|---|---|---|---|
| 2,950,626 | A | 8/1960 | Short | |
| 3,119,274 | A | 1/1964 | Short | |
| 3,433,082 | A | 3/1969 | Bitter et al. | |
| 3,777,825 | A | 12/1973 | Gullich | |
| 3,789,933 | A | 2/1974 | Jarecki | |
| 3,809,168 | A | 5/1974 | Fromm | |
| 3,834,468 | A | 9/1974 | Hettich et al. | |
| 3,998,278 | A | 12/1976 | Stiltz et al. | |
| 4,161,242 | A | 7/1979 | Moores, Jr. et al. | |
| 4,223,744 | A | 9/1980 | Lovingood | |
| 4,752,178 | A | 6/1988 | Greenhill | |
| 4,823,885 | A | 4/1989 | Okumura | |
| 4,901,987 | A | 2/1990 | Greenhill et al. | |
| 5,004,054 | A * | 4/1991 | Sheen | 173/178 |
| 5,025,903 | A | 6/1991 | Elligson | |
| 5,056,607 | A | 10/1991 | Sanders | |
| 5,339,908 | A * | 8/1994 | Yokota et al. | 173/216 |
| 5,343,961 | A | 9/1994 | Ichikawa | |
| 5,375,665 | A | 12/1994 | Fanchang et al. | |
| 5,449,043 | A | 9/1995 | Bourner et al. | |
| 5,451,127 | A | 9/1995 | Chung | |

(Continued)

FOREIGN PATENT DOCUMENTS

| | | |
|---|---|---|
| DE | 297 22 981 U1 | 3/1998 |

(Continued)

*Primary Examiner*—Rinaldi I. Rada
*Assistant Examiner*—Michelle Lopez
(74) *Attorney, Agent, or Firm*—Brinks Hofer Gilson & Lione

(57) ABSTRACT

An impact rotary tool is provided that is switchable between an impact mode where the tool delivers an impacting torque on an output tool and a drill mode where the driver delivers a smooth output on an output tool. The impact rotary tool includes an impact mechanism and a hammer block that in the impact mode is movable parallel to the axis of the driver shaft and delivers reciprocating blows to rotate an anvil and in the drill mode substantially constantly engages the anvil. The impact mechanism includes a stopper that does not contact the hammer block in the impact mode and engages the hammer block in the drill mode to maintain the substantially constant contact between the hammer block and the anvil.

21 Claims, 13 Drawing Sheets

U.S. PATENT DOCUMENTS

| | | | |
|---|---|---|---|
| 5,458,206 | A | 10/1995 | Bourner et al. |
| 5,531,278 | A | 7/1996 | Lin |
| 5,558,393 | A | 9/1996 | Hawkins et al. |
| 5,568,849 | A | 10/1996 | Sasaki et al. |
| 5,588,496 | A | 12/1996 | Elger |
| 5,622,358 | A | 4/1997 | Komura et al. |
| 5,628,374 | A | 5/1997 | Dibbern, Jr. |
| 5,639,074 | A | 6/1997 | Greenhill et al. |
| 5,673,758 | A | 10/1997 | Sasaki et al. |
| 5,704,433 | A | 1/1998 | Bourner et al. |
| 5,711,379 | A | 1/1998 | Amano et al. |
| 5,711,380 | A | 1/1998 | Chen |
| 5,842,527 | A | 12/1998 | Arakawa et al. |
| 5,960,923 | A | 10/1999 | Araki |
| 6,045,303 | A | 4/2000 | Chung |
| 6,068,250 | A | 5/2000 | Hawkins et al. |
| 6,073,939 | A | 6/2000 | Steadings et al. |
| 6,142,242 | A | 11/2000 | Okumura et al. |
| 6,179,301 | B1 | 1/2001 | Steadings et al. |
| 6,192,996 | B1 | 2/2001 | Sakaguchi et al. |
| 6,202,759 | B1 | 3/2001 | Chen |
| 6,305,481 | B1 | 10/2001 | Yamazaki et al. |
| 6,457,535 | B1 | 10/2002 | Tanaka |
| RE37,905 | E | 11/2002 | Bourner et al. |
| 6,478,095 | B2 | 11/2002 | Neumaier |
| 6,502,648 | B2 | 1/2003 | Milbourne |
| 6,523,658 | B2 | 2/2003 | Furuta et al. |
| 6,550,546 | B2 | 4/2003 | Thurler et al. |
| 6,610,938 | B2 | 8/2003 | Fünfer |
| 6,640,679 | B1 | 11/2003 | Roberts, Jr. |
| 6,666,284 | B2 | 12/2003 | Stirm |
| 6,676,557 | B2 | 1/2004 | Milbourne et al. |
| 6,688,406 | B1 | 2/2004 | Wu et al. |
| 6,691,796 | B1 | 2/2004 | Wu |
| 6,712,156 | B2 | 3/2004 | Fünfer |
| 6,758,465 | B1 | 7/2004 | Greenhill et al. |
| 6,789,631 | B1 | 9/2004 | Realme, Sr. et al. |
| 6,793,023 | B2 | 9/2004 | Holzer et al. |
| 6,824,491 | B2 * | 11/2004 | Chen ..... 475/266 |
| 6,892,827 | B2 | 5/2005 | Toyama et al. |
| 7,044,882 | B2 * | 5/2006 | Eisenhardt ..... 475/298 |
| 7,124,839 | B2 * | 10/2006 | Furuta et al. ..... 173/104 |
| 2001/0015530 | A1 | 8/2001 | Steadings et al. |
| 2002/0096341 | A1 | 7/2002 | Hagan et al. |
| 2002/0096342 | A1 | 7/2002 | Milbourne |
| 2002/0098938 | A1 | 7/2002 | Milbourne et al. |
| 2002/0121384 | A1 | 9/2002 | Saito et al. |
| 2003/0089509 | A1 | 5/2003 | Wanek et al. |
| 2003/0098168 | A1 | 5/2003 | Frauhammer et al. |
| 2003/0146007 | A1 | 8/2003 | Greitmann |
| 2003/0171185 | A1 | 9/2003 | Potter et al. |
| 2004/0211576 | A1 | 10/2004 | Milbourne et al. |
| 2005/0034882 | A1 | 2/2005 | Chen |
| 2005/0061521 | A1 | 3/2005 | Saito et al. |
| 2006/0090913 | A1 | 5/2006 | Furuta |

FOREIGN PATENT DOCUMENTS

| | | | |
|---|---|---|---|
| EP | 1 555 091 | A2 | 7/2005 |
| GB | 2077151 | A | 12/1981 |
| GB | 2241754 | A | 9/1991 |
| JP | 2000-237970 | | 9/2000 |
| JP | 2001-241465 | | 9/2001 |
| JP | 2003-191113 | | 7/2003 |
| WO | WO 02/059500 | A1 | 8/2002 |

* cited by examiner

IMPACT ROTARY TOOL WITH DRILL MODE

BACKGROUND

The present invention relates to power tools, and in particular to an impact rotary tool capable of switching between different modes of operation.

A conventional combination drill may provide more than one mode of operation. For example, a first mode, referred to as a drill mode, provides continuous rotation of the output spindle without torque limitation during drilling operations. A second mode, referred to as an impact mode, provides the output spindle with impacting blows to rotate the output shaft in an impacting fashion.

Despite the convenience of a dual mode tool, it would still be desirable to provide a tool where the output torque can be adjusted to limit the potential for stripping the heads or threads of fasteners due to excess torque from the tool.

BRIEF SUMMARY

The present invention provides an impact rotary tool that can be selectively switched between an impact mode and a drill mode. The impact rotary tool includes an impact mechanism with a hammer block connected to a drive shaft and an anvil that is disposed concentrically with the drive shaft and configured to be selectively engaged by the hammer block. When the impact rotary tool is in the impact mode, the hammer block is movable along a longitudinal axis of the drive shaft against the biasing force of a spring and the hammer block reciprocatingly engages the anvil causing it to rotate. When the impact rotary tool is in the drill mode, the hammer block substantially constantly engages the anvil causing the anvil to rotate.

The impact rotary tool includes a mode selector to selectively transfer operation between an impact mode and a drill mode. When the mode selector is in the impact position, the stopper does not engage the hammer block. When the mode selector is in drill mode, the stopper engages the hammer block to maintain substantially constant contact between the hammer block and the anvil.

The present invention also provides an impact rotary tool that can selectively transfer operation between an impact mode, a drill mode, and a driving mode.

Advantages of the present invention will become more apparent to those skilled in the art from the following description of the preferred embodiments of the invention that have been shown and described by way of illustration. As will be realized, the invention is capable of other and different embodiments, and its details are capable of modification in various respects. Accordingly, the drawings and description are to be regarded as illustrative in nature and not as restrictive.

DETAILED DESCRIPTION

Referring now to FIGS. 1-4, an impact rotary tool 10 according to the present invention is shown. The impact rotary tool 10 is selectively switchable between an impact mode, a drill mode, and a driver mode. Details of the structure used to establish the driver mode and select the desired maximum output torque of the impact rotary tool 10 are described in commonly assigned U.S. Ser. No. 11/090,947, which is fully incorporated herein by reference.

Figure 9:
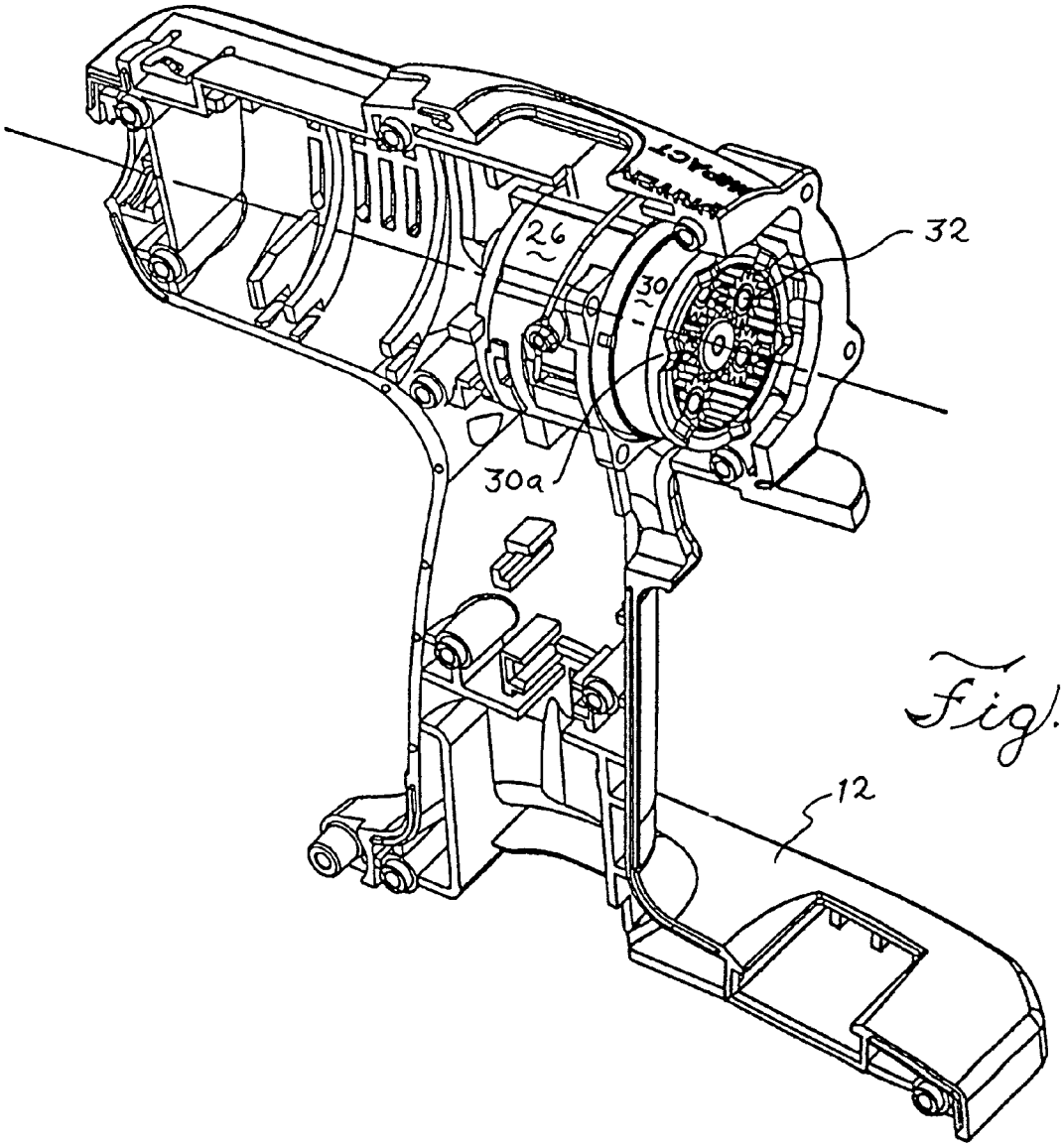
FIG. 9 is a view of one half of the housing supporting the components of the rear gearbox housing.

The impact rotary tool 10 includes a housing 12, (FIG. 9) (a second complementary piece is not shown), a motor 11 for generating torque, and a speed reduction gearbox 14. The speed reduction gearbox 14 includes a rear gearbox housing 26 (FIG. 5) and a front gearbox housing 28. The speed reduction gearbox 14 is mounted within the housing pieces 12 and rotatably connects the output shaft (not shown) of the motor 11 to the drive shaft 18 via a clutch mechanism 16. The clutch mechanism 16 is capable of switching the impact rotary tool 10 between a drill mode and a driver mode of operation, as further described below and in U.S. Ser. No. 11/090,947. The drive shaft 18 is connected to an impact mechanism 17 that is connected to an output spindle 76 (that is shown as formed with an anvil) and chuck 100 adapted to securely grasp a tool bit for engaging a workpiece.

The impact mechanism 17 includes a hammer block 70. The hammer block 70 is cup shaped with a front face from which at least one projection 72 extends toward the front of the tool. Desirably, the hammer block 70 has two projections 72. The hammer block 70 has a central aperture through which the shaft extends. A cavity is defined between an inner peripheral wall adjacent the shaft and an outer peripheral wall spaced from the inner peripheral wall. The cavity has a size suitable to receive a spring 78, as described in more detail below.

The hammer block 70 is rotated by the drive shaft 18 based on torque ultimately received from the motor 11 and transferred through the gearbox 14. The hammer block 70 rotates along with the drive shaft 18 but can move in a direction parallel to the longitudinal axis of the drive shaft 18, when the impact rotary tool 10 is placed in impact mode. The hammer block 70 is held stationary with respect to the drive shaft 18 when the impact rotary tool 10 is in either a drill or a driver mode.

The portion of the inner wall of the hammer block 70 includes a groove 73. A bearing (not shown) is located radially between drive shaft 18 and the groove 73 in the portion of the inner peripheral wall to form a cam mechanism. When the impact rotary tool 10 is in the impact mode, the drive shaft 18 rotates the hammer block 70 and the cam mechanism provides a relatively frictionless surface for the hammer block 70 to selectively translate longitudinally along the longitudinal axis of the drive shaft 18.

In the impact mode, the hammer block 70 selectively engages an anvil 76 to transfer torque to the anvil 76. The anvil 76 includes radially extending arms 77 that can be engaged by the projection 72 on the hammer block 70. The hammer block 70 is biased in a direction toward the anvil 76 by a spring 78 that fits within the cavity and is retained in position by a spring plate 79. When the drive shaft 18 rotates, at least one projection 72 rotatingly engages the arms 77 on the anvil 76 to transfer torque to spin the anvil 76. Eventually, the counter-torque felt on the anvil 76 due to the operation of the output tool on a workpiece (not shown) increases in magnitude relative to the torque provided to the hammer block 70. In this situation, the hammer block 70 feels less resistance by translating laterally along the cam with respect to the drive shaft 18 in a direction away from the anvil 76 until the hammer block 70 no longer engages the anvil 76. As the hammer block 70 translates longitudinally away from the anvil 76, the spring 78 compresses and gains potential energy.

After the spring 78 is sufficiently compressed, the amount of potential energy within the spring 78 becomes large enough to decompress the spring 78 and accelerate the hammer block 70 along the longitudinal axis of the drive shaft 18, as aided by the cam, toward the anvil 76. The front face of the hammer block 70 strikes the arm 77 of the anvil 76 and, because the hammer block 70 is rotating, the projections contact the arms 77 to rotate the anvil 76. After the initial impact, the counter-torque again may again be relatively high compared to the torque in the hammer block 70 such that the hammer block 70 translates away from the anvil 76 along the cam and the impacting cycle continues and the anvil 76 (and output tool) rotates in an impacting or pulsating manner.

Figure 3:
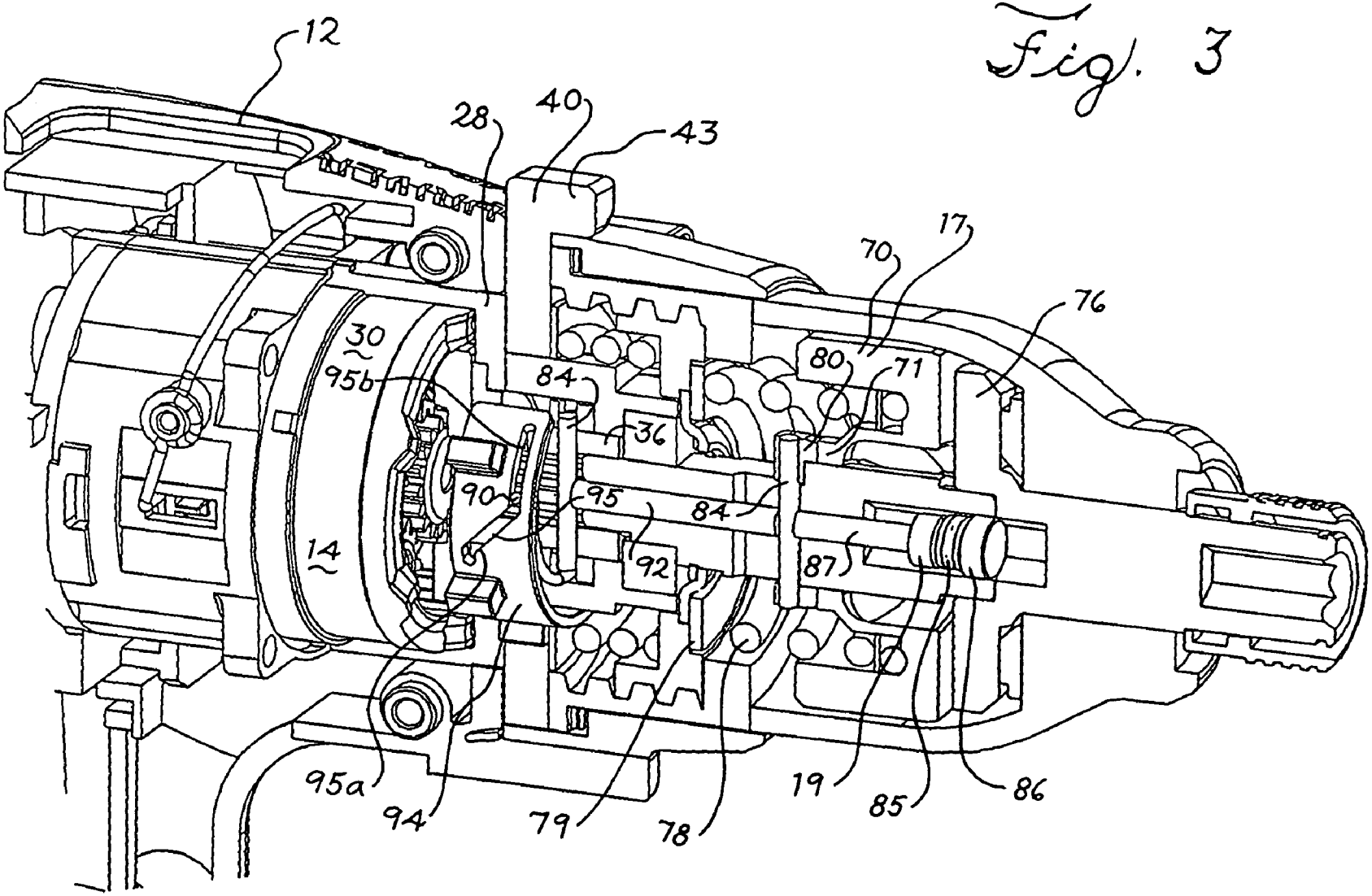
FIG. 3 is the view of FIG. 2 in a driver mode.
Figure 4:
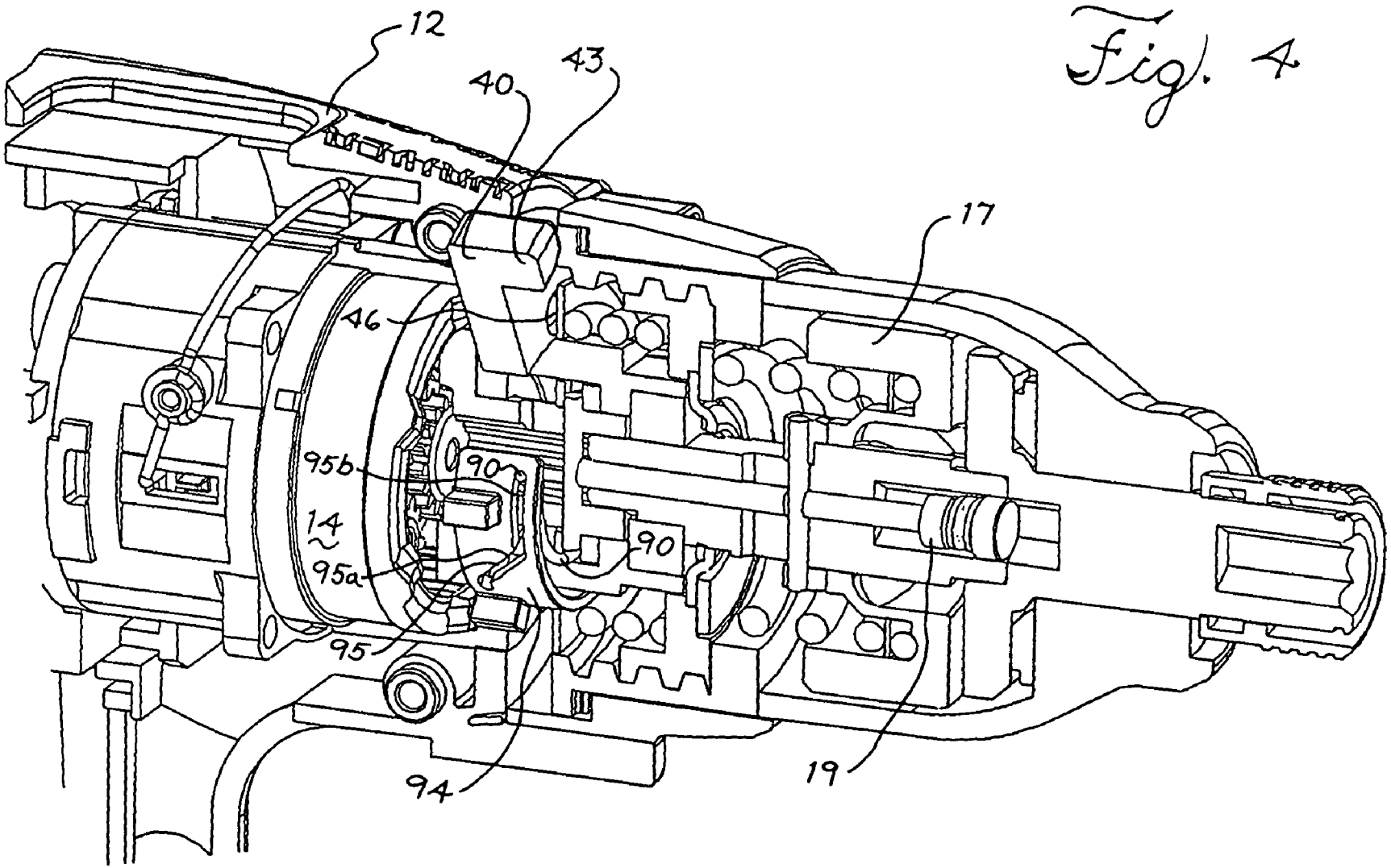
FIG. 4 is the view of FIG. 2 in a drill mode.

As best seen in FIGS. 3 and 4, (driver and drill mode, respectively) the hammer block 70 is prevented from translating in the longitudinal direction along the drive shaft 18. As a result, the projections 72 continuously contact the arms 77 of the anvil 76 and are not permitted to slip from contact (as in the impact mode). In other words, all the torque transferred to the hammer block 70 is transferred to the anvil 76 and the anvil 76 rotates smoothly.

Figure 1:
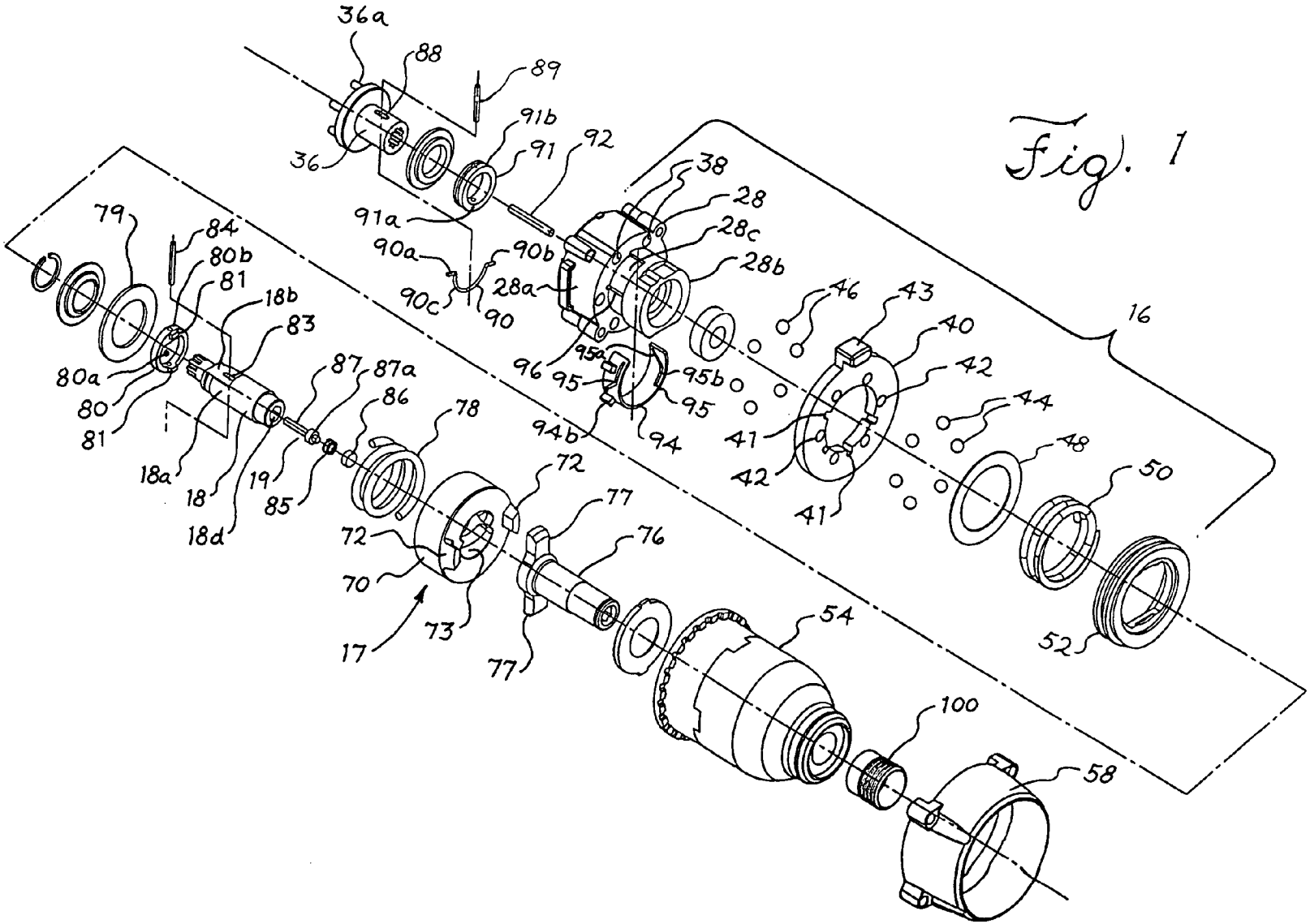
FIG. 1 is a partial exploded view of the internal components forming the clutch and impact mechanisms of an first representative embodiment of an impact rotary tool according to the present invention.

A stopper 80, best seen in FIG. 1, is provided and, depending on the selected mode, the stopper can prevent the hammer block 70 from translating with respect to the drive shaft 18 (driver and drill mode) or allow it to translate (impact mode). The stopper 80 is annular with a central bore that surrounds the drive shaft yet allows the stopper to move along the drive shaft 18. To prevent the stopper 80 from rotating with respect to the drive shaft 18, the central bore has a flat portion 80*a* along a chord that engages a corresponding flat region 18*a* of the drive shaft. The flat portion 80*a* of the stopper 80 and the flat region 18*a* of the drive shaft 18 interact to prevent the stopper 80 from rotating with respect to the drive shaft 18.

The stopper 80 includes two arms 81 that extend axially from a forward surface of the stopper 80. The stopper 80 also includes an aperture 80*b* that extends through a diameter of the stopper 80 along an axis parallel to the front surface of the stopper 80 and perpendicular to the flat portion 80*a* of the center hole.

When the stopper 80 is moved to the forward position within the tool, (the structure to move the stopper 80 is discussed below) the stopper arms 81 engage a rear member 71 (FIGS. 2 and 3) formed on the inner peripheral wall of the hammer block 70 to prevent longitudinal movement of the hammer block 70 away from the anvil 76. Because the hammer block 70 cannot move along the longitudinal axis of the drive shaft 18, the projections 72 from the hammer block 70 continually contact with the arms 77 of the anvil 76, and the torque felt by the hammer block 70 is smoothly transferred to the anvil.

The drive shaft 18 includes a longitudinal slot 83 that extends along a plane perpendicular to the flattened region on the engagement portion 18*a* of the drive shaft 18. A first pin 84 is respectively inserted through the aperture in the stopper 80 and through the longitudinal slot 83 in the drive shaft 18. Therefore, the stopper 80 can translate linearly with respect to the drive shaft 18 along the length bounded by the longitudinal slot 83.

The drive shaft 18 additionally contains a hollow cavity that runs through the length and along the longitudinal axis of the drive shaft 18. A blind section 18*d* of the cavity extending from the forward end toward the rear end has a diameter greater than the section of the cavity behind the blind section 18*d* that extends to the rear end of the drive shaft 18 to define a flange 18*e*. In some embodiments, the blind section 18*d* of the cavity may be hexagonal shaped.

A biasing mechanism 19 that includes a first leg 87, a flange 87*a*, and a spring 85 are disposed within the blind section 18*d* of the cavity. The biasing mechanism 19 is retained within the cavity by a cap 86. The flange 87*a* has a diameter such that it abuts flange 18*e* to prevent rearward travel of the biasing mechanism 19. The rear end of the first leg 87 is positioned within the drive shaft 18 forward of the first pin 84 and the first leg 87 is movable within the drive shaft 18 along the range of potential motion of the first pin 84 within the longitudinal slot 83.

Figure 2:
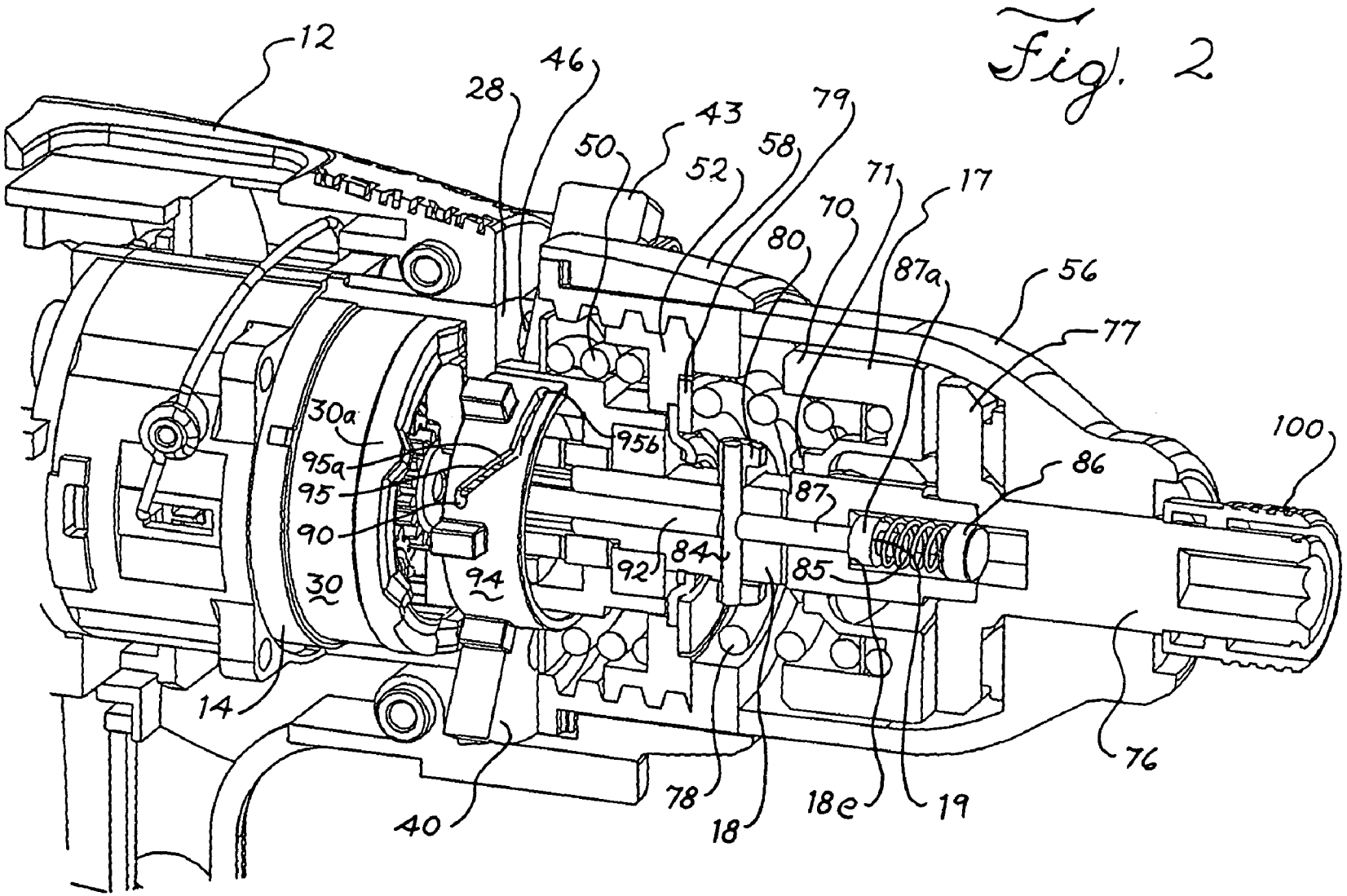
FIG. 2 is a perspective view with a portion of the housing removed to show the impact rotary tool in an impact mode.

In addition, the spring 85 has not end that rests against the flange 87*a* while the other end contacts the cap 86, to bias the biasing mechanism 19 in a rearward direction. Although this biasing force is not sufficient to prevent the forward motion of the first pin 84 and the first leg 87 within the drive shaft 18, when the force that moves the first pin 84 forward is removed, the biasing force of the spring 85 moves the first leg 87 and the first pin 84 rearwardly away from the anvil 76. FIG. 2 shows the flange 87*a* and the first leg 87 biased to the rear position of the slot 83 by the spring 85. FIGS. 3 and 4 show the flange 87*a* and the first leg 87 in the forward position within the drive shaft 18 and further compressing the spring 85.

The first leg 87 and the first pin 84 are moved in the forward direction within the drive shaft 18 when the first pin 84 is pressed forward by the second leg 92. The second leg 92 is provided with a forward end inserted into the drive shaft 18 cavity so that it contacts the first pin 84 and extends out of the rear end of the drive shaft 18. FIGS. 2-4 show the engagement between the forward end of the second leg 92 and the first pin 84 within the drive shaft 18.

As seen in the figures, the rear end of the drive shaft 18 is inserted into the hollow planet carrier 36, which extends through the length of the body portion 28*a* and into the shoulder portion 28*b* of the front gearbox housing 28. As seen in FIG. 1, the forward end of the planet carrier 36 includes a slot 88. The slot 88 accepts a pin 89 that can be moved within the slot 88 based on corresponding forward motion of a link 90 through mutual engagement of the link 90 and the pin 89 with a spacer 91. The pin 89 also contacts the rear end of the second leg 92 such that forward motion of the pin 89 within the slot 88 causes the second leg 92 to move forward within the drive shaft 18, causing forward motion of the first pin 84, first leg 87 and flange 87*a*, which compresses the spring 85. When the link 90 no longer forces the components forward, the biasing force of the spring 85 causes the first leg 87, the first pin 84, the second leg 92, and the second pin 89 to move rearwardly away from the anvil 76.

Each end of the second pin 89 extends out of the slot 88 in the planet carrier 36 and is accepted into holes 91*a* formed along a diameter of a spacer 91. The spacer 91 also has an indented portion 91*b* that is adapted to retain an arcuate portion 90*c* of the link 90, as discussed below.

As best seen in FIG. 1, the shoulder portion 28*b* of the front gearbox housing 28 has a recessed section 28*c* with an outer diameter that is movably engaged by a sleeve 94. The recessed section 28*c* additionally includes two longitudinal slots 96 (only one shown in the figures, which is representative) arranged along a single plane. The slots 96 are the same width as the recessed section 28*c*. A link 90 is provided with two arms 90*a*, 90*b* that extend away from each other along the same line and an arcuate section 90*c* connecting the arms 90*a*, 90*b*. The arcuate section 90*c* is enclosed within the hollow center of the shoulder portion 28*b* of the front gearbox housing 28 and within a curved indented portion 91*b* of the spacer 91 that surrounds the planet carrier 36, through which the second pin 89 extends (along with the planet carrier 36). Each arm 90*a*, 90*b* of the link 90 extends through one of the slots 96 in the recessed section 28*c*. Because both the second pin 89 and the link 90 engage the spacer 91, longitudinal motion of either the link 90 or the second pin 89 causes the same longitudinal motion of the other of these components.

The sleeve 94 is formed in the shape of a "C" and is positioned over the recessed section 28*c* of the front gearbox housing 28. The sleeve 94 includes two tracks 95 on opposite sides of the sleeve 94. An arm 90*a*, 90*b* of the link 90 is inserted through a respective slot 96 in the first gearbox housing 28 and a track 95 of the sleeve 94. Each track 95 is formed such that rotation of the sleeve 94 with respect to the front gearbox housing 28 causes the link 90 to translate linearly along the longitudinal axis of the slots 96 formed in the front gearbox housing 28.

Each of the two tracks 95 have a first portion 95*a* and a second portion 95*b*. The first portion 95*a* causes longitudinal motion of the respective arm along the slot in the recessed section 28*c* when the sleeve 94 is rotated with respect to the front gearbox housing 28. The second portion 95*b* maintains the arms in the forward end of the slot when the sleeve 94 is rotated further with respect to the front gearbox housing 82, i.e. the second portion 95*b* of the track 95 is perpendicular to the second slot 88 when the sleeve 94 is on the front gearbox housing 28.

As will be discussed below, when the arms 90*a*, 90*b* are each at the rear end of the first portion 95*a* of each track 95 (shown in FIG. 2), the tool is in impact mode. When the arms are at the vertex between the two portions 95*a*, 95*b* of the tracks 95 (shown in FIG. 3), the impact rotary tool is in driver mode. When the arms are at the end of the second portion 95*b* of the track 95 (shown in FIG. 4), the impact rotary tool is in drill mode.

As discussed above, the pin 89 engages the rear end of the second leg 92. Therefore, when the sleeve 94 is rotated to cause the link 90 to move forward within the track 95, the second leg 92 also moves forward within the drive shaft 18 because of the forward movement of the second pin 89. As discussed above, this forward motion of the second leg 92 causes forward motion of the first pin 84, the stopper 80, and the first leg 87, which further compresses the spring 85. When the stopper 80 moves forward, it engages the hammer block 70 and prevents any rearward motion of the hammer block 70. Therefore, the hammer block 70 makes constant contact with the anvil 76 to rotate it in a smooth fashion. When the sleeve 94 is rotated in the opposite direction, the link 90 and the second pin 89 translate rearwardly within the tool, releasing the force that compresses the spring 85 within the blind cavity 18*d*. The spring 85 then expands, biasing the first leg 87 and first pin 84 rearwardly. The stopper 80 also moves rearwardly and no longer contacts the hammer block 70 allowing the hammer block 70 to reciprocate along the drive shaft 18.

The sleeve 94 additionally includes a plurality of tabs 94*b* that extend radially from its outer circumference. The tabs 94*b* are oriented to fit within a plurality of keyways 41 formed within the mode selector 40. The mode selector 40 surrounds the sleeve 94 and the recessed section 28*c* of the front gearbox housing 28. The mode selector 40 includes a handle 43 that extends out of the tool housing 12 to allow the user to rotate the mode selector 40 to change the mode of operation of the impact rotary tool. Because the tabs 94*b* of the sleeve 94 are engaged within the keyways 41 on the mode selector, rotation of the mode selector 40 causes simultaneous rotation of the sleeve 94, which allows the impact rotary tool to switch between impact mode and drill or driver modes, as discussed above. The movement of the mode selector 40 between the drill mode position and the driver mode position switches the tool between these modes by engaging and disengaging the clutch mechanism 16, in the manner that is discussed below.

As mentioned above, the impact rotary tool includes a motor 11 to rotate the drive shaft 18 through a gearbox 14. The impact rotary tool also includes a clutch mechanism 16 that allows the user to control the maximum amount of output torque applied to the output spindle when the tool is in driver mode (shown in FIGS. 3 and 7). The clutch mechanism 16 is discussed in detail below.

Figure 5:
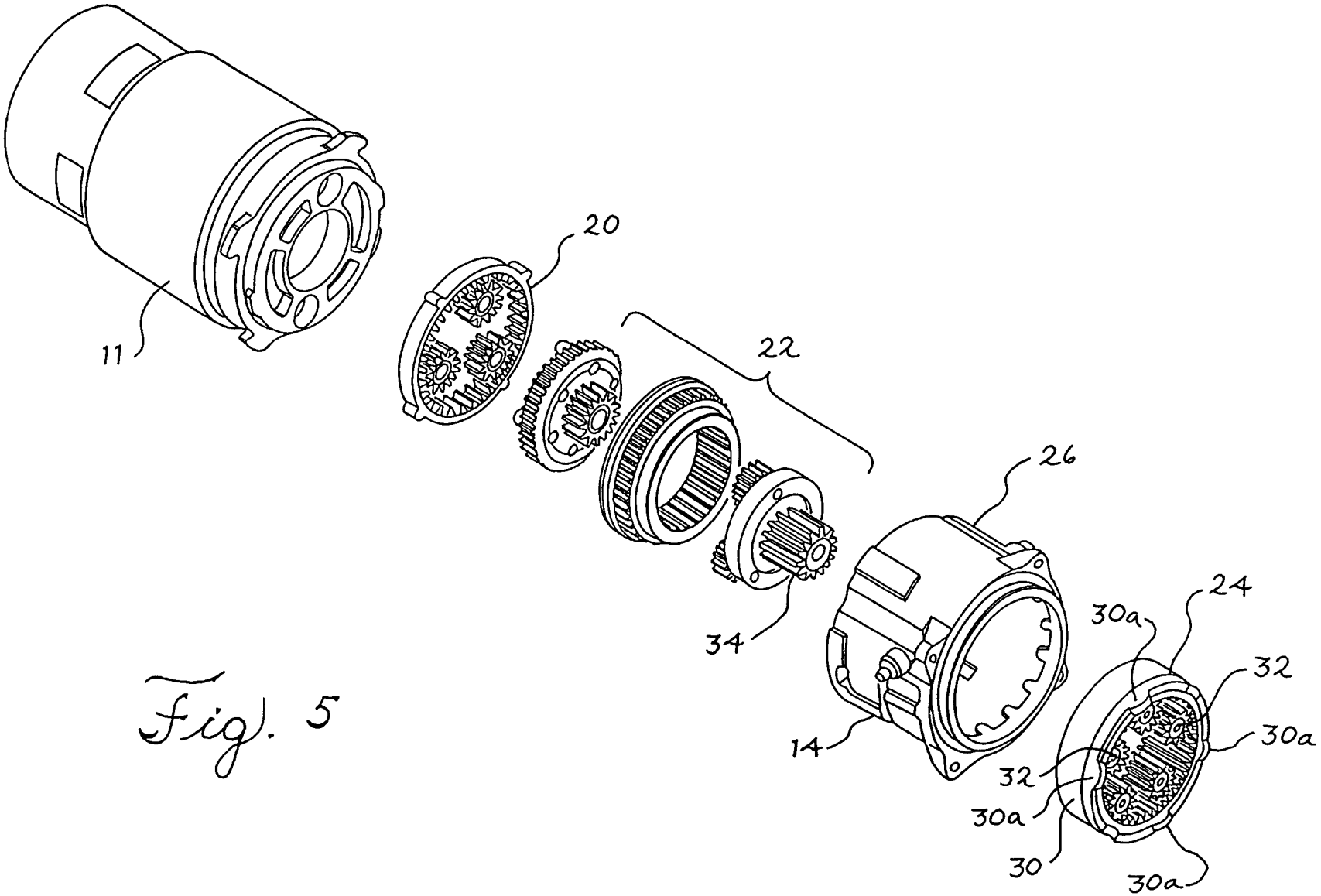
FIG. 5 is an exploded view of the components forming the motor and planetary gear train.

As best seen in FIG. 5, the gearbox 14 includes at least one, and as shown in the figure, a pair of planetary gear sets 20 and 22 having a conventional structure for transmitting rotation or torque of the motor 12 and reducing the speed of the motor 11. The shaft (not shown) of the motor 11 forms a sun gear (not shown) that rotatably engages the first planetary gear set 20, which drives the second planetary gear set 22. As can be appreciated by one of ordinary skill in the art, the first and second planetary gear sets 20 and 22 are arranged inside a rear gearbox housing 26 to provide a two-speed gear reduction between the output shaft of the motor 11 and the pinion gear 34 of the second planetary gear set 22. A speed selector switch (not shown) may be provided on the rear gearbox housing 26 for selecting a high speed range for fast drilling or driving applications or a low speed range for high power and torque applications. When using the rotary tool 10 in the high speed range, the speed will increase and the drill will have less torque. When using the rotary tool 10 in the low speed range, the speed will decrease and the drill will have more torque. When the rotary tool 10 is operated in impact mode in the high speed range, the tool provides a maximum tightening torque for high torque applications. When the rotary tool 10 is operated in impact mode in low speed range, the tool provides less tightening torque to avoid over tightening that could lead to damage to soft surfaces or a fastener.

The gearbox 14 may further include a third planetary gear set 24 that is arranged inside the front gearbox housing 28 for cooperating with the clutch mechanism 16 to rotate the drive shaft 18. The third planetary gear set 24 includes a ring gear 30 and a set of planetary gears 32. The ring gear 30 is selectively rotatably disposed inside a body portion 28*a* of the front gearbox housing 28. The body portion 28*a* of the front gearbox housing 28 is secured to the rear gearbox housing 26 (FIG. 5), for example, using fasteners (not shown) that are received in threaded holes formed on the outer surface of the body portion 28*a* and corresponding through holes formed on a flange of the rear gearbox housing 26. The planetary gears 32 mesh with the ring gear 30 and the pinion gear 34 of the second planetary gear set 22. The planetary gears 32 are rotatably supported on axial projections 36*a* of a planet carrier 36 that is coupled to the rear end of the drive shaft 18 for rotation therewith. The drive shaft 18 is rotatably received inside a shoulder portion 28*b* of the front gearbox housing 28. As best seen in FIG. 1, both the rear end of the drive shaft 18 and the forward internal circumference of the planet carrier 36 may be formed and connected together with spline connections to prohibit any relative rotation between the two and transfer the torque felt on the planet carrier 36 to the drive shaft 18.

The pinion gear 34 of the second planetary gear set 22 operates as a sun gear to drive the planetary gears 32 of the third planetary gear set 24. If the ring gear 30 is rotatably fixed inside the body portion 28*a* of the front gearbox housing 28, the planetary gears 32 will orbit the pinion gear 34 to drive the planet carrier 36 and the drive shaft 18 to rotate about the axis of the pinion gear 34. This arrangement positively transmits torque from the pinion gear 34 to the drive shaft 18. In contrast, if the ring gear 30 is allowed to rotate or idle inside the front gearbox housing 28, the pinion gear 34 may not transmit torque to the drive shaft 18 and may instead drive the planetary gears 32 to spin about their own axis on the axial projections 36*a* of the carrier 36.

A plurality of protrusions 30*a* are formed circumferentially on the outer shoulder of ring gear 30 for cooperating with the clutch mechanism 16 to selectively inhibit the ring gear 30 from rotating relative to the front gearbox housing 28, as described in further detail below. The protrusions 30*a* are arranged to cooperate with a set of pass through openings 38 that are formed circumferentially in the body portion 28*a* of the front gearbox housing 28 and that extend through the body portion 28*a*.

The clutch mechanism 16 includes a set of link members 46, a mode selector 40, and a set of bypass members 44. Each opening 38 in the body portion, 28*a* movably receives at least one link member 46, for example, a cylindrical or spherical member, therein. The mode selector 40, for example, in the form of a ring, is rotatably mounted on the shoulder portion 28*b* of the front gearbox housing 28 and is axially fixed on the recessed section 28*c* immediately adjacent the body portion 28*a*. The mode selector 40 is provided with a notch spring (not shown) that cooperates with one or more notches (not shown) formed on the body portion 28*a* to secure the mode selector 40 when it is rotated between the different positions, as described in further detail above and below.

A single opening or, as shown, a plurality of openings 42 are formed circumferentially on the mode selector 40 to cooperate with the pass through openings 38 in the body portion 28*a*. Each opening 42 in the mode selector 40 movably receives a bypass member 44 therein, for example, in the form of a spherical member, a pin having a hexagonal, square, or circular cross section, or other shapes. In this way, the link members 46 abut against the shoulder of ring gear 30 at one end of the body portion 28*a* and the bypass members 44 at the opposite end of the body portion.

A retaining washer 48 and a spring 50 are loosely supported on the shoulder portion 28*b* of the front gearbox housing 28 in front of the mode selector 40. The spring 50 presses against the retaining washer 48 to urge the bypass members 44 into engagement with the link members 46 so as to bias the link members 46 against the shoulder of the ring gear 30.

The spring 50 is disposed between the retaining washer 48 and an annular spring seat 52. The spring seat 52 is non-rotatably fitted over the shoulder portion 28*b* of the front gearbox housing 28. The inner surface of the spring seat 52 and the outer surface of the shoulder portion 28*b* have cooperating surfaces such that the spring seat 52 is moveable only in an axial direction relative to the shoulder portion 28*b*. For example, radial projections formed on the inner surface of the spring seat 52 are received in corresponding axial slots or grooves formed on the shoulder portion 28*b*.

The spring seat 52 has a threaded outer portion to engage a threaded inner portion of a torque adjustment shroud 54 to vary the force acting on the retaining washer 48. The torque adjustment shroud 54 is axially fixed to the front gearbox housing 28 with the use of a cap 58 that surrounds the periphery of the torque adjustment shroud 54. The cap 58 is connected to the front gearbox housing 28 with a plurality of fasteners (not shown) to retain the torque adjustment shroud 54 in position.

This arrangement allows the torque adjustment shroud 54 to rotate relative to the housing 28. Rotation of the torque adjustment shroud 54 causes the threaded inner portion to engage and move the spring seat 52 in an axial direction. The direction of rotation of the torque adjustment shroud 54 determines whether the spring seat 52 is moved against or away from the spring 50 for increasing or decreasing the force acting on the retaining washer 48.

Figure 6:
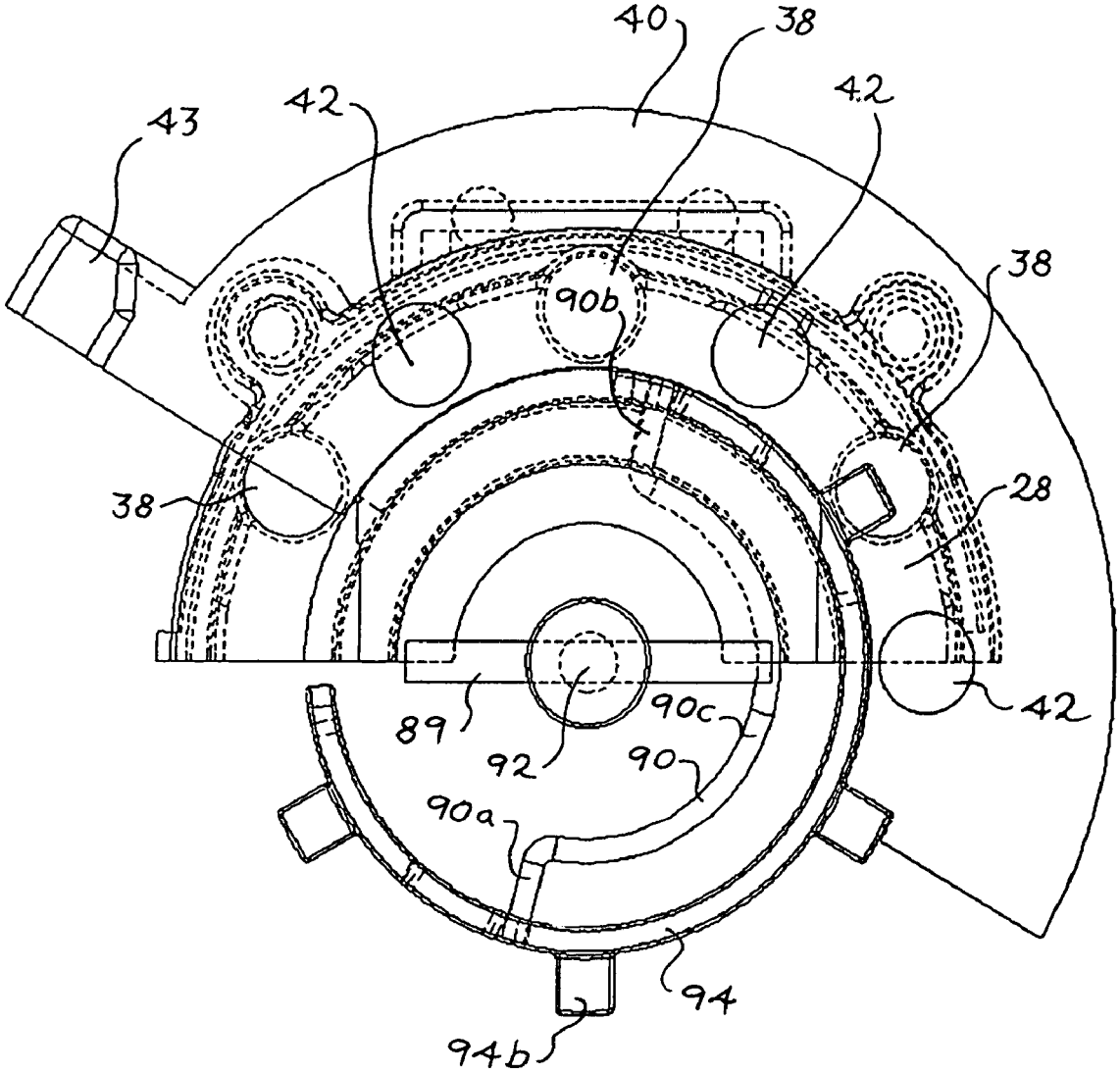
FIG. 6 is a front view of the mode selector and the components associated with the front gearbox housing in an impact mode.
Figure 8:
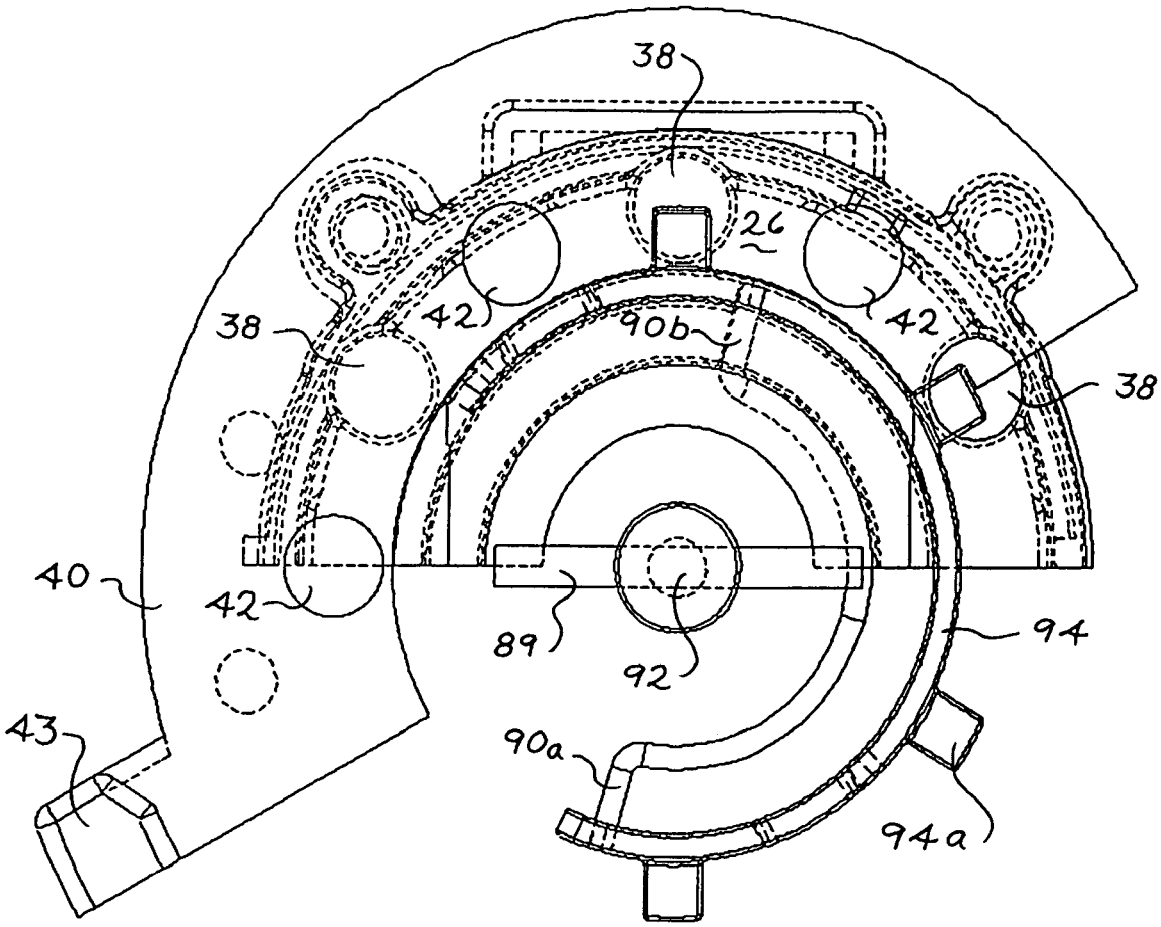
FIG. 8 is the view of FIG. 6 shown in a drill mode.

As best seen in FIGS. 6 and 8, in each of the impact and drill modes, the mode selector 40 is rotated to a first position such that the openings 42 in the mode selector 40, and the bypass members 44 received therein, are oriented away from the openings 38 in the body portion 28*a*. In this way, the link members 46 inside the openings 38 are axially blocked between the shoulder of ring gear 30 and the mode selector 40. This arrangement causes the protrusions 30*a* on the shoulder of the ring gear 30 to firmly engage the link members 46 so as to prevent the ring gear 30 from rotating inside the front gearbox housing 28. Accordingly, the motor 11 will drive the drive shaft 18 for sustained rotation without any torque limitation of the ring gear 30.

Figure 7:
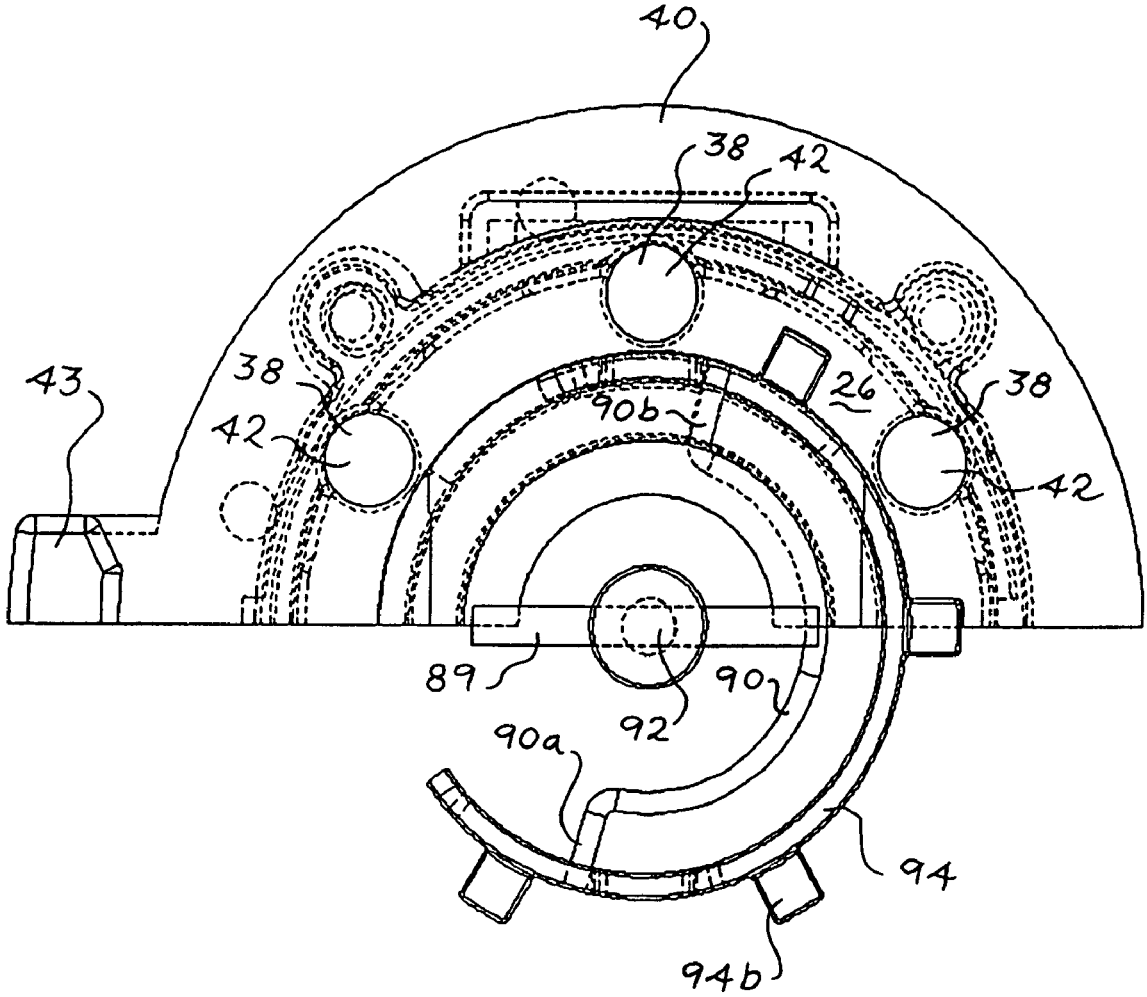
FIG. 7 is the view of FIG. 6 shown in a driver mode.

As best seen in FIG. 7, in the driver mode the mode selector 40 is rotated to a position such that the openings 42 are aligned with the openings 38 in the body portion 28*a*. As a result, the link members 46 and the bypass members 44 can be displaced forward in an axial direction against the force of the retaining washer 48 and the spring 50. If the load on the output shaft is sufficient to overcome the torque on the ring 30, the ring gear 30 will lift the link members 46 over the protrusions 30*a* so as to rotate inside the front gearbox housing 28. In particular, the protrusions 30*a* have a ramped surface for biasing the link members 46 axially when the ring gear 30 rotates. When the ring gear 30 is made rotatable in this way, the motor 11 will not transmit torque to the drive shaft 18. In the driver mode, the torque limitation of the ring gear 30 is adjusted by rotating the torque adjustment shroud 54 to vary the spring force acting on the retaining washer 48, as described above.

Therefore, this arrangement for the clutch mechanism 16 using the mode selector 40 to block the link members 46, as described above, allows a user to switch between the drill and driver modes of operation without affecting the torque limitation setting of the drive mode.

Figure 10:
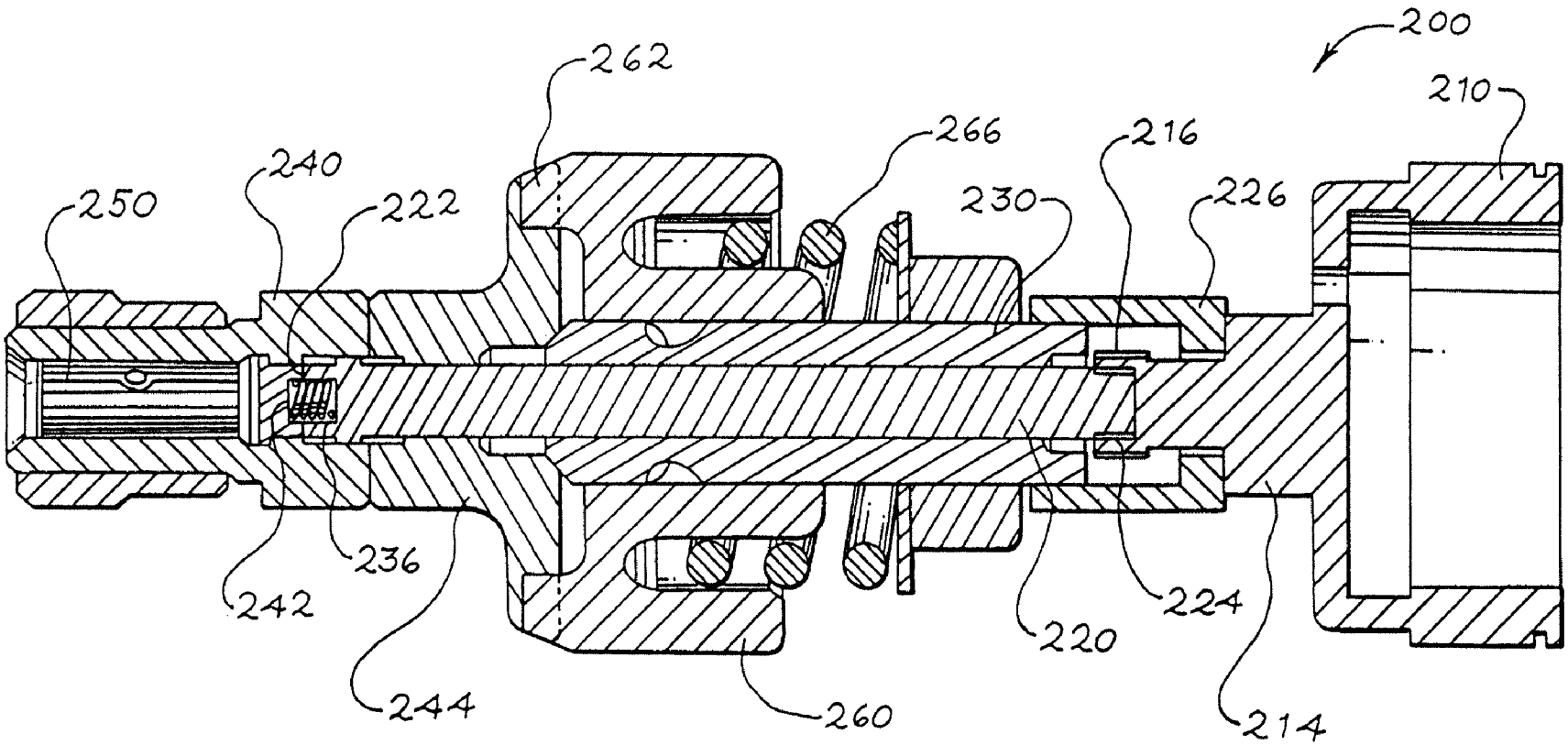
FIG. 10 is a cross-sectional view of the internal components of a second embodiment of an impact rotary tool, showing the impact rotary tool in a drill or driver mode.
Figure 11:
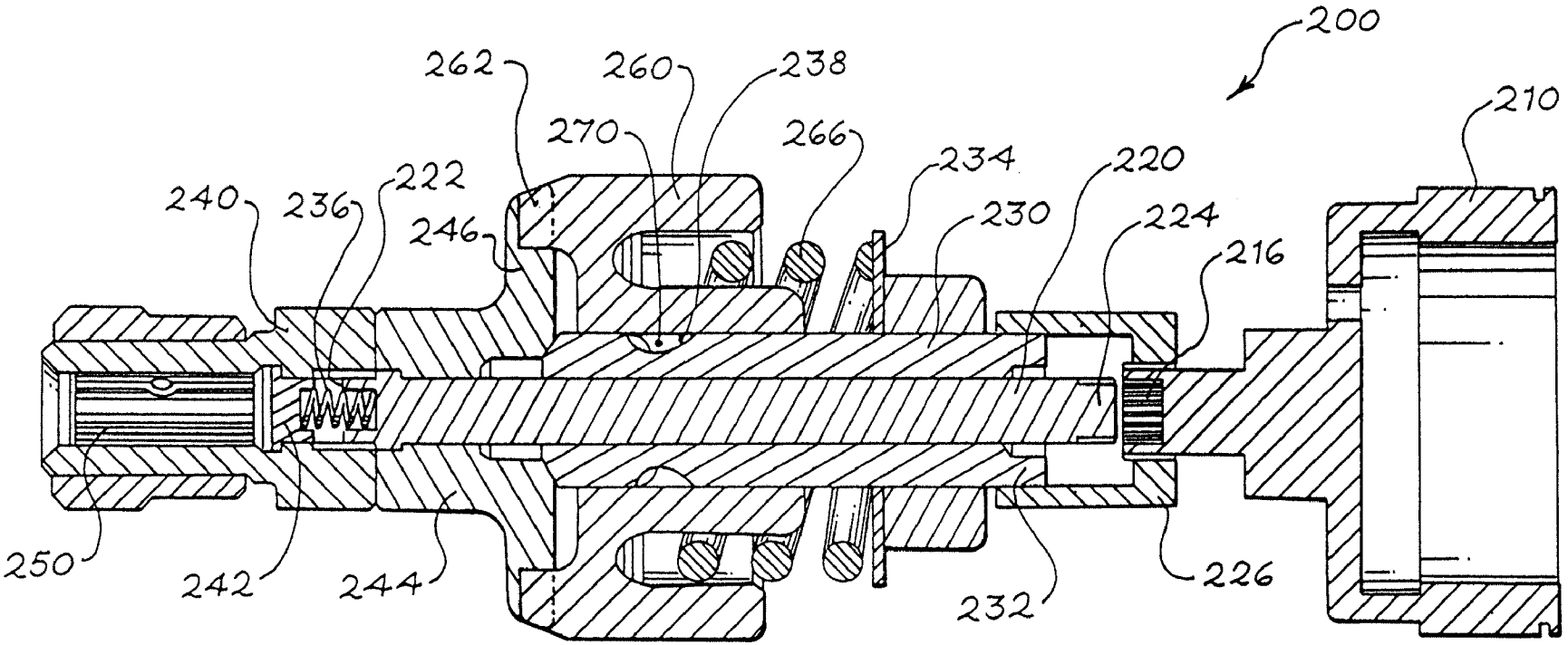
FIG. 11 is a cross-sectional view of the impact rotary tool of FIG. 10, showing the tool in an impact mode.

A second embodiment of the impact rotary tool is shown in FIGS. 10 and 11. The second embodiment includes many of the standard features of an impact rotary tool 200 including a motor (not shown) and a gear train (not shown) that provides an output to rotate the spindle 210. The structure disclosed in this second embodiment also allows the impact rotary tool 200 to operate in either impact mode, as shown in FIG. 11, or in drill or driver mode, as shown in FIG. 10. The gear train includes a clutch mechanism (not shown) that is similar in structure and operation to that described in the first embodiment above, and fully disclosed in commonly owned U.S. patent application Ser. No. 11/090,947, which is fully incorporated by reference herein.

The spindle 210 includes a forward engaging end 216 that can selectively engage either a rear end of an inner shaft 220 through a spline connection 216, 224 to transfer the torque ultimately from the motor to the inner shaft, or can engage a bracket 226 that is coupled with an outer shaft 230 to transfer torque to the outer shaft 230. The outer shaft 230 is coaxial with and surrounds the inner shaft 220, although the two shafts are assembled to allow either shaft to rotate without the other shaft rotating.

Each of the inner shaft 220 and the outer shaft 230 can be selectively engaged with the output shaft 240 to provide torque to rotate a tool that is connected to the output shaft 240 by a chuck 250, depending on the mode of tool operation selected by the user.

As shown in FIG. 10, the impact rotary tool 200 is oriented in a drill or a driver mode. The inner shaft 220 is engaged with the spindle 210 and the forward end 222 of the inner shaft 220 engages a rear end of the output shaft 240 through a spline connection to transfer torque to the output shaft 240. In this orientation, the output shaft 240 freely rotates with respect to the anvil 244, which remains stationary. Because the anvil 244 and the outer shaft 230 do not rotate in this orientation, the hammer block 260 also remains stationary. A spring 236 is positioned between the forward end 222 of the inner shaft 220 and the rear end 242 of the output shaft 240. The spring 236 operates to bias the inner shaft 220 rearwardly such that when the inner shaft 220 is not being driven by the spindle 210, the inner shaft 220 does not engage the output shaft 240 through the spline connection.

As shown in FIG. 11, the impact rotary tool 200 is oriented in an impact mode. The rear end 232 of the outer shaft 230 is connected to the bracket 226, which can engage the forward end of the spindle 210 through a spline connection. In this orientation, the inner shaft 220 does not engage the spindle 210 and therefore does not rotate with the spindle. As shown in FIG. 11, the outer shaft 230 rotates with the spindle 210, which causes the hammer block 260 to also rotate. The hammer block 260 is rotatably connected to the outer shaft through a cam 270 that operates with a bearing (not shown) riding within a recess 238 formed in the outer shaft 230. The hammer block 260 includes projections 262 that selectively engage arms 246 that extend from anvil 244 to transfer torque to spin the anvil 244. The hammer block 260 translates parallel to the longitudinal axis of the outer shaft 230 with the motion of the cam 270 against the biasing force of a spring 266 to make repeated reciprocating contact with the anvil 244.

The anvil 244 engages the output shaft 240 of the driver when the tool 200 is in impact mode to transfer the reciprocating impact torque felt on the anvil 244 to the output shaft 240. Because the hammer block 260, anvil 244, and the outer shaft 230 are stationary during operation of the impact rotary tool 200 in drill or driver modes, the impact rotary tool 200 is operated more efficiently because power is not needed to overcome the inertia to rotate these components and keep the hammer block 260 reciprocating.

Figure 12:
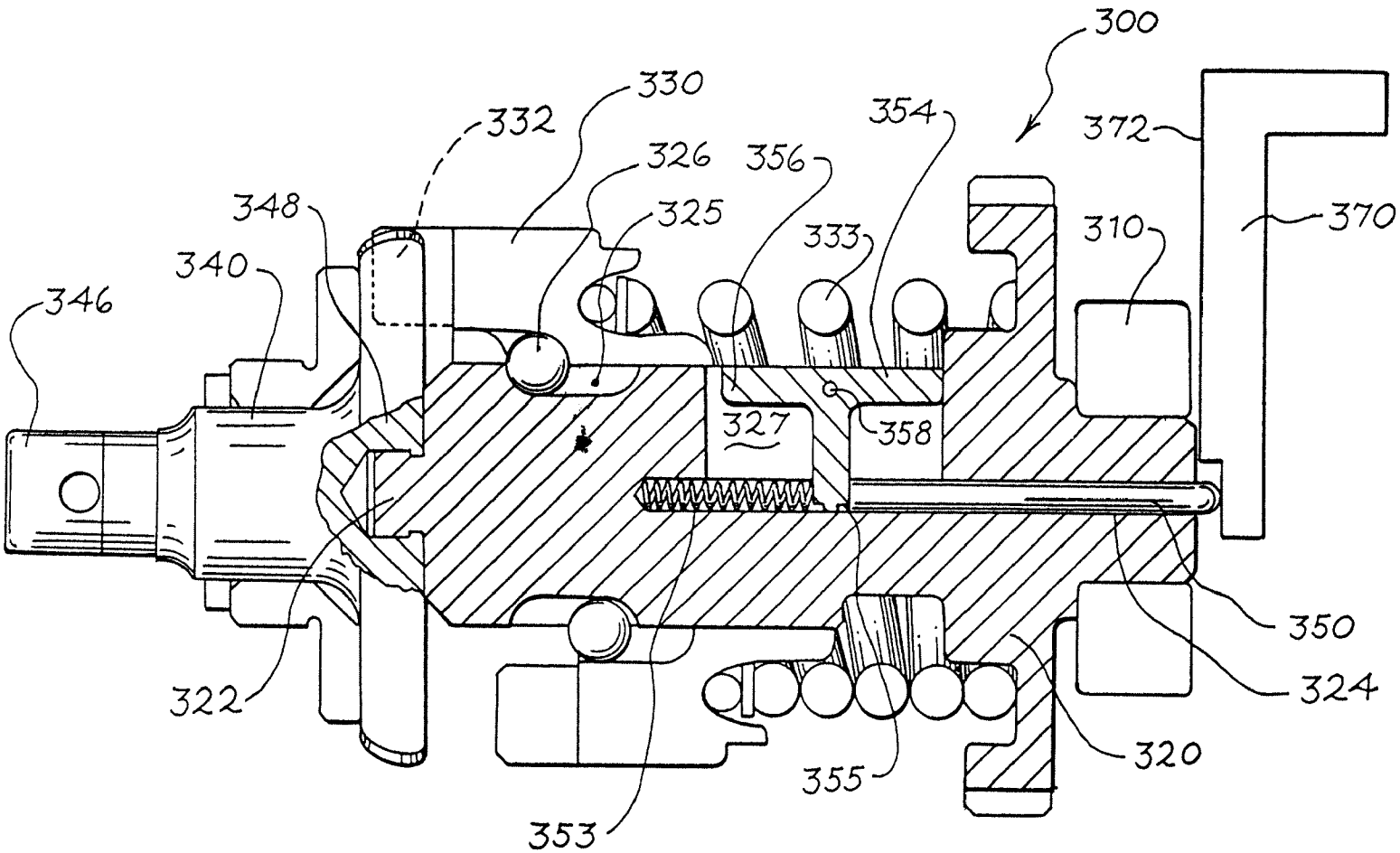
FIG. 12 is a cross-sectional view of the internal components of a third representative embodiment of an impact rotary tool, showing the impact rotary tool in an impact mode.
Figure 13:
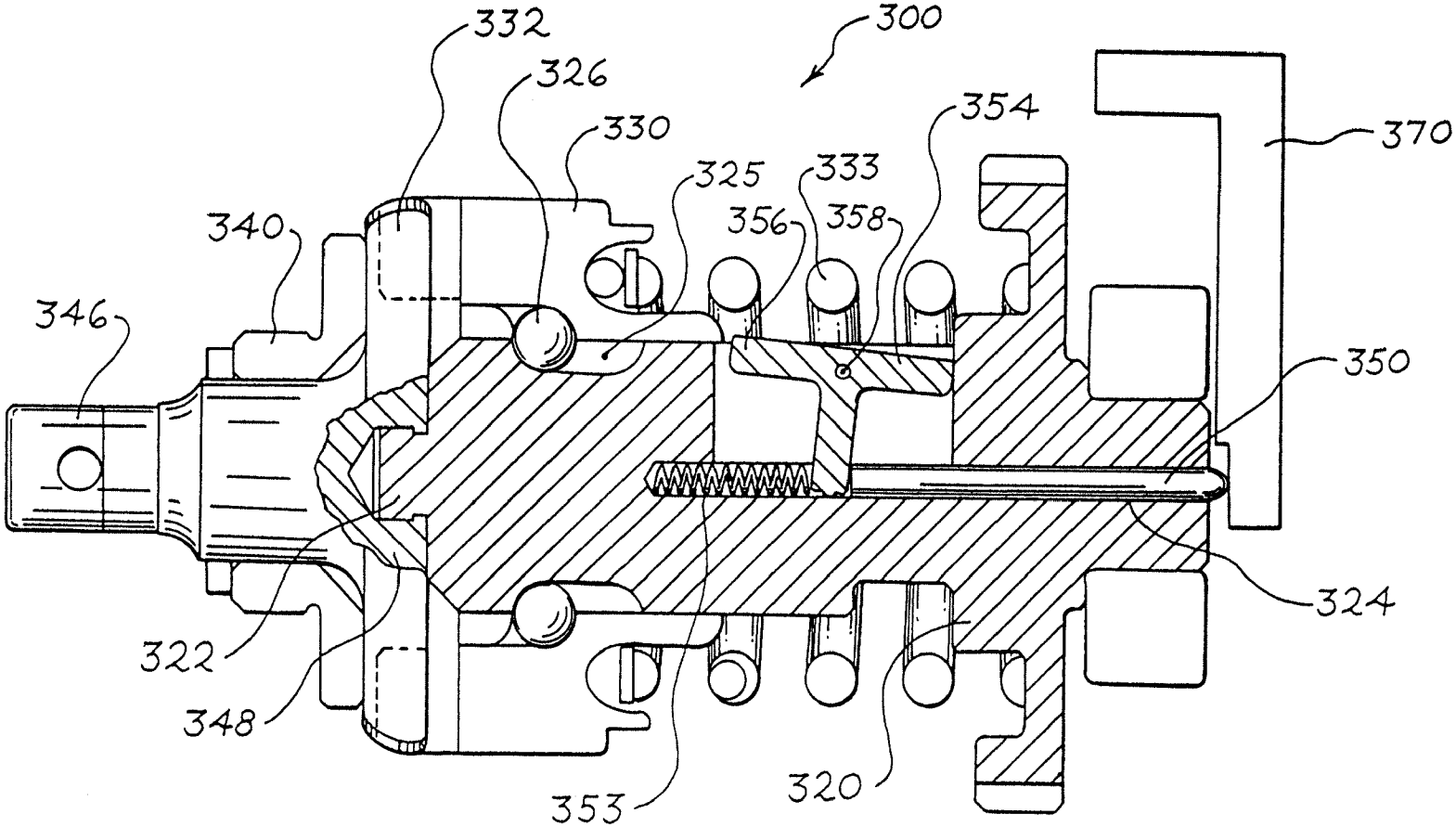
FIG. 13 is a cross-sectional view of the impact rotary tool of FIG. 12, showing the tool in a drill or a driver mode.

A third embodiment of an impact rotary tool is shown in FIGS. 12-13. This embodiment includes many of the standard features of an impact rotary tool 300 including a motor (not shown) and a gear train (not shown) that provides an output to rotate the spindle 320. The structure disclosed in this third embodiment also allows the tool to operate in either an impact mode, as shown in FIG. 12, or in a drill or a driver mode, as shown in FIG. 13. The gear train includes a clutch mechanism (not shown) that is similar in structure and operation to that described in the first embodiment above, and fully disclosed in commonly owned U.S. patent application Ser. No. 11/090,947, which is fully incorporated by reference herein.

FIG. 12 shows the impact rotary tool 300 in an impact mode. The impact rotary tool 300 includes a drive shaft 320 that is rotatably engaged by an input spindle (not shown), which receives torque ultimately from the motor through a gear train. The drive shaft 320 includes a center bore 324 that extends from the rear end of the drive shaft 320 through a majority of the length of the drive shaft 320 but does not extend through the front end of the shaft 320. A rod 350 is inserted into the bore 324 to extend out of the rear end of the drive shaft 320. The drive shaft 320 additionally includes a cavity 327 that extends from the outer circumference of the drive shaft and intersects with the center bore 324. A bracket 354 shaped as a "T" is positioned within the cavity 327 and is rotatably mounted to the drive shaft 320 with a pin 358. The lower tip 355 of the bracket 354 extends within the volume that includes part of the center bore 324 and the cavity 327 and the forward end of the rod 350 that engages the rear of the lower tip 355 of the bracket 354.

The bracket 354 is rotatably connected with the pinned connection to the drive shaft 320 so that it rotates with the movement of the rod 350 within the center bore 324 of the drive shaft 320. For example, when the rod 350 is moved forward within the drive shaft 320, the bracket rotates clockwise as shown in FIG. 12. The bracket 354 is biased to rotate in the counter-clockwise direction by a spring 353 positioned within the center bore 324 within the drive shaft, between the forward end of the center bore 324 and the forward end of the lower tip 355 of the bracket 354. When the rod 350 is urged forward within the drive shaft 320, the bracket 354 rotates so that the forward tip 356 rises above the outer circumference of the drive shaft 320 while also compressing the spring 353. When the rod 350 is no longer urged forward within the drive shaft 320, the spring 353 expands to rotate the bracket 354 in the counter-clockwise direction, which lowers the forward tip 356 of the bracket 354 and moves the rod 350 rearwardly through the center bore 324 of the drive shaft 320.

The impact rotary tool 300 additionally includes a hammer block 330 that is connected to the drive shaft 320. The hammer block 330 rotates based on the torque felt in the drive shaft 320 and also reciprocates parallel to the longitudinal axis of the drive shaft 320 against the biasing force of a spring 333, similar to the operation of the hammer blocks discussed above. A cam formed with a steel ball 326 rides within a recess 325 within the drive shaft 320. The operation of the cam is similar to the operation of the cams described above.

As with conventional impact rotary tools, and the embodiments discussed above, the hammer block 330 has projections 332 that make reciprocating contact with an anvil 340 to transfer the torque in the drive shaft 320 to the anvil 340 in an impacting fashion. The anvil 340 is connected to or integral with an output chuck 346 that holds an output tool (not shown), as is conventional in impact rotary tools.

FIG. 12 shows the impact rotary tool 300 in the impact mode. The bracket 354 is aligned (based on the position of the rod 350 within the center bore 324) such that the front end 356 is in line with the outer circumference of the drive shaft 320 and the hammer block 330 is free to reciprocate with respect to the drive shaft 320 and impart impacting blows on the anvil 340.

FIG. 13 shows the impact rotary tool 300 in a drill or a driver mode. The bracket 354 is aligned (based on the position of the rod 324 within the center bore 324) such that the front end 356 of the bracket 354 extends above the circumference of the drive shaft 320 and prevents the hammer block 330 from moving rearwardly within the impact rotary tool 300. Because the hammer block 330 is prevented from moving rearwardly, it makes substantially constant contact with the anvil 340 and therefore smoothly transfers the torque on the drive shaft to the anvil 340. When the impact rotary tool 300 is transferred back to impact mode, the rod 350 is moved rearwardly and the spring 353 expands to rotate the bracket 354 in the counter-clockwise direction. This lowers the forward end 356 of the bracket 354 and again allows the hammer block 330 to reciprocate and impart impact blows to rotate the anvil 340.

The rod 350 is moved within the center bore 324 of the drive shaft 320 based on the rotation of the switch 370. In a preferred embodiment, the forward surface 372 of the switch has a ramped surface (not shown) which acts as a cam to move the rod 350 within the center bore 324 of the drive shaft 320. Therefore, when the impact rotary tool 300 is in the impact mode, the switch 370 is oriented such that the ramp surface allows the bracket 354 (and rod 350) to be biased by the spring 353 into a position where the forward end 356 is in-line with the circumference of the drive shaft 320 to allow the hammer block 330 to reciprocate with respect to the drive shaft 320. When the impact rotary tool 300 is switched to the drill or driver modes, the switch is rotated so that rod 350 engages a portion of the ramp surface that extends further forward and moves the rod 350 forward within the center bore 324 to rotate the bracket 354 clockwise against the biasing force of the spring 353 until the forward end 356 extends above the circumference of the drive shaft 320 to stop the hammer block 330 from reciprocating.

As discussed above, when the switch 370 is rotated to the impact mode, the spring 353 forces the lower tip 355 of the bracket 354 and the rod 350 rearward until the bracket 354 rotates counter-clockwise to allow the hammer block 330 to again reciprocate within the tool and impart impacting forces on the anvil 340. The structure discussed in the embodiments above can be adapted to selectively move the rod 350 to change the mode of operation of the impact rotary tool 300. Additionally, other methods of moving the rod 350 linearly within the drive shaft that are known to those of ordinary skill in the art can be used as well.

It is therefore intended that the foregoing detailed description be regarded as illustrative rather than limiting, and that it be understood that it is the following claims, including all equivalents, that are intended to define the spirit and scope of this invention.

What is claimed:

1. An impact rotary tool, comprising:

(a) a gearbox connected to a motor and a drive shaft;

(b) an impact mechanism including a hammer block connected to the drive shaft and an anvil disposed concentrically with the drive shaft and configured to be selectively engaged by the hammer block, (c) a mode selector moveable between a first orientation where the hammer block is movable parallel to a longitudinal axis of the drive shaft against the biasing force of a spring to cause reciprocating engagement with the anvil and to cause the anvil to rotate and a second orientation where the hammer block substantially constantly engages the anvil causing the anvil to rotate, and;

(d) a switching mechanism including a stopper that is movable along the outer surface of the drive shaft with motion of the mode selector, and the stopper is connected to a first pin that moves along a first slot in the drive shaft, wherein when the mode selector is in the first orientation, the stopper does not engage the hammer block and when the mode selector is in the second orientation the stopper engages the hammer block to maintain substantially constant contact between the hammer block and the anvil.

2. The impact rotary tool of claim 1 wherein the first pin is oriented substantially perpendicular to the longitudinal axis of the drive shaft.

3. The impact rotary tool of claim 1 wherein the mode selector is rotatable about the longitudinal axis of the drive shaft.

4. The impact rotary tool of claim 3 wherein rotational motion of the mode selector causes the stopper to move parallel to the longitudinal axis of the drive shaft.

5. The impact rotary tool of claim 1, wherein the switching mechanism comprises a planet carrier with a longitudinal second slot operatively engaged with a set of planetary gears, wherein the second slot receives a second pin that is movable along the second slot with motion of the mode selector.

6. The impact rotary tool of claim 5, wherein movement of the second pin within the second slot causes motion of the first pin within the first slot.

7. The impact rotary tool of claim 6 wherein the switching mechanism further comprises a sleeve that rotates with the mode selector and is operatively engaged with the second pin.

8. The impact rotary tool of claim 7 wherein the sleeve includes a track through which an arm of a link extends, wherein the link is engaged with the second pin, and wherein rotation of the sleeve causes motion of the link and the second pin.

9. The impact rotary tool of claim 6 wherein a leg is disposed between the second pin and the first pin, and the leg is partially inserted within a hollow cavity along the longitudinal axis of the drive shaft.

10. The impact rotary tool of claim 9 wherein the switching mechanism further comprises a second leg disposed forward of the first pin within the hollow cavity of the drive shaft, wherein the second leg is rearwardly biased by a second spring disposed within the hollow cavity.

11. The impact rotary tool of claim 1 wherein the mode selector is selectively moveable to a third orientation wherein the hammer block substantially constantly engages the anvil causing the anvil to rotate and wherein a clutch mechanism is operable to selectively transmit a torque from the motor to the anvil based on a selectable output torque level.

12. An impact rotary tool, comprising:

(a) a motor connected to a drive shaft through a gearbox;

(b) an impact mechanism including a hammer block connected to the drive shaft and an anvil disposed concentrically with the drive shaft and configured to be selectively engaged by the hammer block;

(c) a mode selector moveable between a first orientation where the hammer block is movable parallel to a longitudinal axis of the drive shaft against the biasing force of a spring for reciprocating engagement with the anvil to cause the anvil to rotate, a second orientation where the hammer block substantially constantly engages the anvil causing the anvil to rotate, and a third orientation where the hammer block substantially constantly engages the anvil causing the anvil to rotate and wherein a clutch mechanism is operable to selectively transmit a torque from the motor to the anvil based on an selectable output torque level; and (d) a switching mechanism including a stopper that is movable along the outer surface of the drive shaft with the motion of the mode selector, wherein the stopper is connected to a first pin that moves along a slot in the drive shaft, wherein when the mode selector is in the first orientation, the stopper does not engage the hammer block and when the mode selector is in the second and third orientations, the stopper engages the hammer block to maintain substantially constant contact between the hammer block and the anvil.

13. The impact rotary tool of claim 12 wherein the first pin is oriented substantially perpendicular to the longitudinal axis of the drive shaft.

14. The impact rotary tool of claim 12 wherein the mode selector is rotatable about the longitudinal axis of the drive shaft.

15. The impact rotary tool of claim 14 wherein rotational motion of the mode selector causes the stopper to move parallel to the longitudinal axis of the drive shaft.

16. The impact rotary tool of claim 12, wherein the switching mechanism comprises a planet carrier with a longitudinal second slot operatively engaged with a set of planetary gears, wherein the second slot receives a second pin that is movable along the second slot with motion of the mode selector.

17. The impact rotary tool of claim 16, wherein movement of the second pin within the second slot causes motion of the first pin within the first slot.

18. The impact rotary tool of claim 17 wherein the switching mechanism further comprises a sleeve that rotates with the mode selector and the sleeve is operatively engaged with the second pin.

19. The impact rotary tool of claim 18 wherein the sleeve includes a track through which an arm of a link extends, wherein the link is engaged with the second pin, and wherein rotation of the sleeve causes motion of the link and the second pin.

20. The impact rotary tool of claim 17 wherein a first leg is disposed between the second pin and the first pin, and the first leg is partially inserted within a hollow cavity along the longitudinal axis of the drive shaft.

21. The impact rotary tool of claim 20 wherein the switching mechanism further comprises a second leg disposed forward of the first pin within the hollow cavity of the drive shaft, wherein the second leg is rearwardly biased by a second spring disposed within the hollow cavity.

* * * * *

UNITED STATES PATENT AND TRADEMARK OFFICE
Certificate

Patent No. 7,410,007 B2

Patented: August 12, 2008

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Koon For Chung, Sai Kung (HK); Hoi Pang Wang, Tseung Kwan O (HK); and Ho Chi Hong, Kwai Chung (HK)

Signed and Sealed this Twenty-ninth Day of May 2012.

RINALDI I. RADA
*Supervisory Patent Examiner*
Art Unit 3721
Technology Center 3700